US010580612B2

(12) United States Patent
Park et al.

(10) Patent No.: US 10,580,612 B2
(45) Date of Patent: Mar. 3, 2020

(54) ELECTRON EMISSION SOURCE AND X-RAY GENERATOR USING THE SAME

(71) Applicant: ELECTRONICS AND TELECOMMUNICATIONS RESEARCH INSTITUTE, Daejeon (KR)

(72) Inventors: Sora Park, Seoul (KR); Yoon-Ho Song, Daejeon (KR); Jin-Woo Jeong, Daejeon (KR); Jun Tae Kang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 155 days.

(21) Appl. No.: 15/861,554

(22) Filed: Jan. 3, 2018

(65) Prior Publication Data

US 2018/0190466 A1 Jul. 5, 2018

(30) Foreign Application Priority Data

Jan. 3, 2017 (KR) ..... 10-2017-0000888
Dec. 14, 2017 (KR) ..... 10-2017-0172652

(51) Int. Cl.
*H01J 35/06* (2006.01)
*H01J 19/38* (2006.01)
*H01J 35/14* (2006.01)

(52) U.S. Cl.
CPC ..... *H01J 35/065* (2013.01); *H01J 19/38* (2013.01); *H01J 35/14* (2013.01); *H01J 2235/06* (2013.01)

(58) Field of Classification Search
CPC .. H01J 35/00; H01J 35/06; H01J 35/14; H01J 35/065; H01J 35/02; H01J 35/04; H01J 35/045; H01J 35/064; H01J 35/16; H01J 19/00; H01J 19/02; H01J 19/24; H01J 19/38; H01J 19/42; H01J 2235/00; H01J 2235/06; H01J 2235/062; H01J 29/64; H01J 37/14; H01J 37/147
(Continued)

(56) References Cited

U.S. PATENT DOCUMENTS 6,900,066 B2 5/2005 Toyota et al.
8,629,609 B2 * 1/2014 Di Carlo ..... H01J 21/20 313/306
(Continued)

FOREIGN PATENT DOCUMENTS

JP H5053115 U 7/1993
KR 20030078024 A 10/2003
(Continued)

OTHER PUBLICATIONS

Jae Won Hwang et al, "Field Emission Behavior of Carbon Nanotube Yarn for Micro-Resolution X-Ray Tube Cathode", Journal of Nanoscience and Nanotechnology, 2013, pp. 7386-7390, vol. 13, American Scientific Publishers, US.

*Primary Examiner* — Jurie Yun

(57) ABSTRACT

An electron emission source includes a cathode electrode having a recess region formed in an upper portion thereof and the yarn emitter having a tip shape and provided in the recess region of the cathode electrode. The yarn emitter is spaced from an inner surface of the recess region of the cathode electrode.

15 Claims, 7 Drawing Sheets

(58) Field of Classification Search
USPC ..... 378/119, 121, 122, 123, 136, 138, 139
See application file for complete search history.

(56) References Cited

U.S. PATENT DOCUMENTS

| | | | | |
|---|---|---|---|---|
| 2012/0169221 | A1* | 7/2012 | Liu | H01J 31/127 313/506 |
| 2013/0336459 | A1* | 12/2013 | Choi | H01J 35/065 378/122 |
| 2016/0307725 | A1 | 10/2016 | Jeong et al. | |
| 2017/0048955 | A1 | 2/2017 | Jeong et al. | |

FOREIGN PATENT DOCUMENTS

| | | | |
|---|---|---|---|
| KR | 10-0948649 | B1 | 3/2010 |
| KR | 20110045938 | A | 5/2011 |
| KR | 10-1675470 | B1 | 11/2016 |

* cited by examiner

ELECTRON EMISSION SOURCE AND X-RAY GENERATOR USING THE SAME

CROSS-REFERENCE TO RELATED APPLICATIONS

This U.S. non-provisional patent application claims priority under 35 U.S.C. § 119 of Korean Patent Application Nos. 10-2017-0000888, filed on Jan. 3, 2017, and 10-2017-0172652, filed on Dec. 14, 2017, the entire contents of which are hereby incorporated by reference.

BACKGROUND

The present disclosure relates to an electron emission source and an X-ray generator using the same, and more particularly, to an electron emission source using the yarn emitter and an X-ray generator using the electron emission source.

In a field emission device using a nanomaterial, carbon nanotubes (CNTs) or carbon nanowires are attracting attention as electron emission materials. The CNTs have a structure in which one-dimensional plates of honeycomb structure are rolled in a tube shape and have very good electrical, mechanical, chemical, and thermal properties, which are applied in various fields. Then, the CNTs having a high aspect ratio may easily emit electrons even in a low potential electric field due to their excellent geometrical characteristics.

The nanomaterial yarns are bonded to each other by van der Waals forces and have a thread-like shape. The nanomaterial yarns may be formed thin and long. When used as a field emission element, nanomaterial yarns having a tip shape may emit electrons at a very small area, and the electric field may be concentrated by the geometrical structure. Therefore, nanomaterial yarns are advantageous for manufacturing the field emission devices requiring high-efficiency and high-density electron beam characteristics such as micro-device and micro-focusing device. In addition, nanomaterial yarns are difficult to be detached individually in the field emission process, so that the emission current may be stably generated.

SUMMARY

The present disclosure provides an electron emission source for generating an electron beam having an improved focusing characteristics and a high-resolution X-ray generator using the electron emission source.

The present disclosure also provides an electron emission source having a reduced leakage current generated during driving and an X-ray generator using the electron emission source.

The present disclosure also provides an electron emission source in which the yarn emitter can be easily replaced and an X-ray generator using the electron emission source.

The present disclosure also provides an electron emission source for generating an electron beam having an improved focusing characteristics and an X-ray generator using the electron emission source.

Exemplary embodiments of the inventive concept provides an electron emission source including: a cathode electrode having a recess region formed in an upper portion thereof; and a yarn emitter having a tip shape and provided in the recess region of the cathode electrode, wherein the yarn emitter is spaced from an inner surface of the recess region of the cathode electrode.

In an embodiment, the yarn emitter may extend from a bottom surface of the recess region in a direction perpendicular to an upper surface of the cathode electrode.

In an embodiment, the yarn emitter may protrude from an upper surface of the cathode electrode.

In an embodiment, the electron emission source may further include a gate electrode having an aperture and disposed at an upper part of the yarn emitter while maintaining a certain distance from the yarn emitter.

In an embodiment, the electron emission source may further include an electron beam transmission layer disposed on one side of the gate electrode and configured to cover the aperture of the gate electrode.

In an embodiment, the electron emission source may further include a focusing electrode provided at a position farther from the cathode electrode than the gate electrode and having an aperture.

In an embodiment, a diameter of the aperture of the focusing electrode may be larger than a diameter of the aperture of the gate electrode.

In an embodiment, the yarn emitter may include a carbon nano tube (CNT).

In an embodiment, a diameter of the hole of the gate electrode may be larger than a width of the yarn emitter.

In an embodiment, the cathode electrode may have a groove formed from the bottom surface of the recess region toward the inside of the cathode electrode, wherein the yarn emitter may be inserted into the groove and mechanically coupled with the cathode electrode.

In an embodiment, the cathode electrode may have a first portion and a second portion which are horizontally separated from each other and are symmetrical with respect to the yarn emitter, wherein the groove may include: a first groove connected to the recessed region in the first portion; and a second groove connected to the recess region in the second portion and corresponding to the first groove, wherein the yarn emitter is coupled to the first groove and the second groove.

Exemplary embodiments of the inventive concept, an X-ray generator includes: an electron emission source; a vacuum tube in which an electron beam generated from the electron emission source travels; a target attached to the vacuum tube so as to be disposed on a traveling path of the electron beam and configured to emit an X-ray by collision with the electron beam; and a magnetic lens disposed outside the vacuum tube and configured to control the traveling path of the electron beam, wherein the electron emission source includes: a cathode electrode having a support part and a potential control part disposed on the support part; and a tip-shaped yarn emitter provided in an aperture vertically penetrating the potential control part.

In an embodiment, the X-ray generator may further include an alignment coil disposed between the electron emission source and the magnetic lens.

In an embodiment, the X-ray generator may further include an electron beam control module disposed on a traveling path of an electron beam between the electron emission source and the magnetic lens.

In an embodiment, the inside of the housing may be in a vacuum state.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
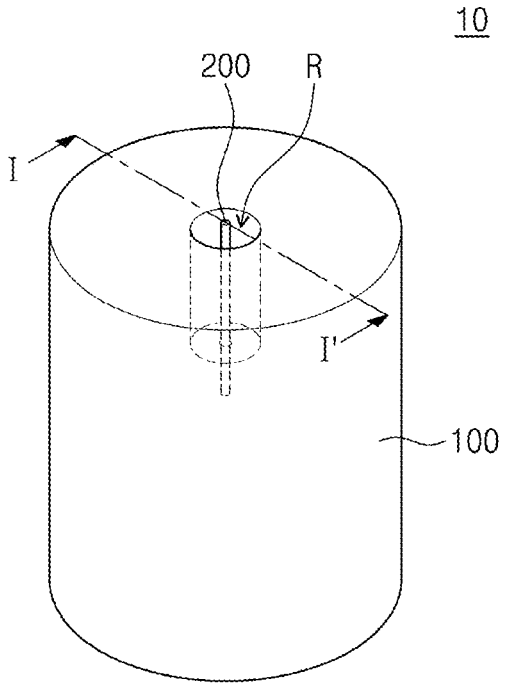
FIG. 1 is a perspective view illustrating an electron emission source according to embodiments of the inventive concept.

In order to fully understand the configuration and effects of the technical spirit of the inventive concept, preferred embodiments of the technical spirit of the inventive concept will be described with reference to the accompanying drawings. However, the technical spirit of the inventive concept is not limited to the embodiments set forth herein and may be implemented in various forms and various modifications may be applied thereto. Only, the technical spirit of the inventive concept is disclosed to the full through the description of the embodiments, and it is provided to those skilled in the art that the inventive concept belongs to inform the scope of the inventive concept completely. Those of ordinary skill in the art will understand that the concepts of the inventive concept may be practiced in any suitable environment.

The terms used in this specification are used only for explaining specific embodiments while not limiting the inventive concept. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

In this specification, when a film (or layer) is referred to as being on another film (or layer) or substrate, it may be directly on the other film (or layer) or substrate, or a third film (or layer) may be interposed.

It will be understood that the terms "first", "second", and "third" are used herein to describe various regions, films (or layers), and so on, but these regions, films (or layers), and so on should not be limited by these terms. These terms are only used to distinguish any predetermined region or film (or layer) from another region or film (or layer). Thus, a membrane referred to as a first membrane in one embodiment may be referred to as a second membrane in another embodiment. Embodiments described herein include complementary embodiments thereof. Like reference numerals refer to like components throughout the specification.

Unless otherwise the terms used in embodiments of the inventive concept are defined differently, they may be interpreted as commonly known to those skilled in the art.

Hereinafter, an electron emission source and an X-ray generator according to the inventive concept will be described with reference to the drawings.

Figure 2:
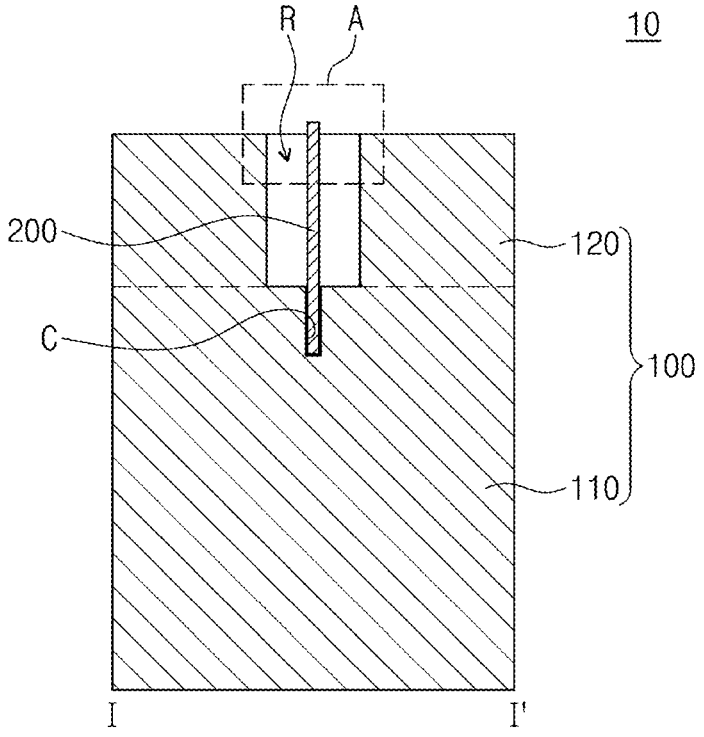
FIG. 2 is a cross-sectional view illustrating an electron emission source according to embodiments of the inventive concept.

FIG. 1 is a perspective view illustrating an electron emission source according to embodiments of the inventive concept. FIG. 2 is a cross-sectional view taken along line I-I' of FIG. 1, illustrating an electron emission source according to embodiments of the inventive concept.

Referring to FIGS. 1 and 2, an electron emission source 10 may be provided. In exemplary embodiments, the electron emission source 10 may emit electrons in an electric field. The electron emission source 10 may be referred to as an electric field electron emission source or an electric field electron emitter. The electron emission source 10 may include a cathode electrode 100 and the yarn emitter 200.

The cathode electrode 100 may have a support part 110 and a potential control part 120. The potential control part 120 is disposed on the upper surface of the support part 110 and may be provided along the outer periphery of the support part 110. The potential control part 120 may have an aperture vertically penetrating its center. The inner wall of the aperture of the potential control part 120 and the upper surface of the support part 110 may define a recessed area R. For example, the recess region R may extend from the upper surface of the cathode electrode 100 toward the inside of the cathode electrode 100. That is, the cathode electrode 100 may have a concave shape in which the center of its upper surface is recessed inwardly. The cathode electrode 100 may have a cylindrical shape. The recessed region R may have a cylindrical shape. However, the above disclosure of the shape of the cathode electrode 100 and the shape of the recessed region R is illustrative, and the inventive concept is not limited thereto. The cathode electrode 100 may include a metal or doped semiconductor material. The cathode electrode 100 may generate an electric field for the yarn emitter 200 to emit electrons.

The yarn emitter 200 may be disposed within the recess region R of the cathode electrode 100. The yarn emitter 200 may have a tip shape. The yarn emitter 200 may extend in a direction perpendicular to the upper surface of the cathode electrode 100 from the bottom surface (which may be the same as the upper surface of the support part 110 of the cathode electrode 100) of the recess region R. At this time, the yarn emitter 200 may be spaced apart from the inner surface (which may be the same as the inner surface of the potential control part 120 of the cathode electrode 100) of the recess region R of the cathode electrode 100. The distance that the yarn emitter 200 is spaced from the inner surface of the recess region R of the cathode electrode 100 may be constant along the direction. For example, when the yarn emitter 200 has a tip shape, the recess region R may have a cylindrical shape, and the yarn emitter 200 may be formed at the center of the recess region R from a plan view. The yarn emitter 200 may be fixed by the cathode electrode 100. A portion of the yarn emitter 200 may be filled from the bottom surface of the recessed region R of the cathode electrode 100 toward the inside of the cathode electrode 100. For example, the yarn emitter 200 may be inserted and fixed in the groove C formed in the bottom surface of the recess region R of the cathode electrode 100. The yarn emitter 200 may be stably fixed as it is inserted and mechanically coupled to the groove C of the cathode electrode 100. In addition, it is possible to stably emit electron beam without a movement of the emission yarn 200 when the electron emission source 10 operates. That is, the structural stability of the electron emission source 10 may be improved. The yarn emitter 200 may protrude from the upper surface of the cathode electrode 100. That is, the upper surface of the yarn emitter 200 may be located at a higher level than the upper surface of the cathode electrode 100. However, the inventive concept is not limited to this, and the yarn emitter 200 may be disposed such that its upper surface is located at the same level as the upper surface of the cathode electrode 100 or lower than the upper surface of the cathode electrode 100 if necessary. The yarn emitter 200 may include a conductive nanomaterial. For example, the yarn emitter 200 may include a carbon nanotube (CNT). Generally, the yarn emitter 200 may be formed by drawing and yarning threads from nanowires or nanotubes grown perpendicular to the substrate. When provided in an electric field, the yarn emitter 200 may emit electrons. At this time, it is possible to adjust the electron emission of the yarn emitters 200 by controlling the applied electric field value.

Figure 3:
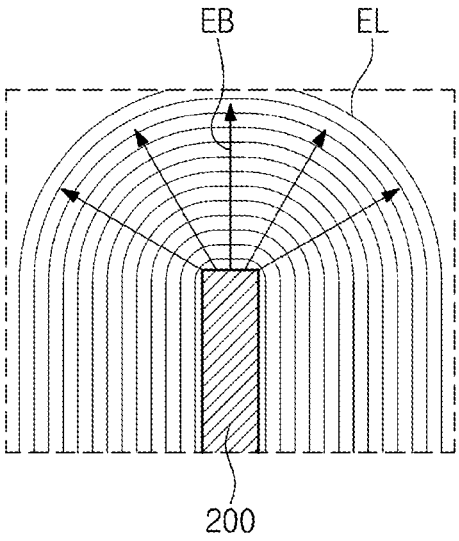
FIG. 3 is a view for explaining the electron beam formation of the yarn emitter.
Figure 4:
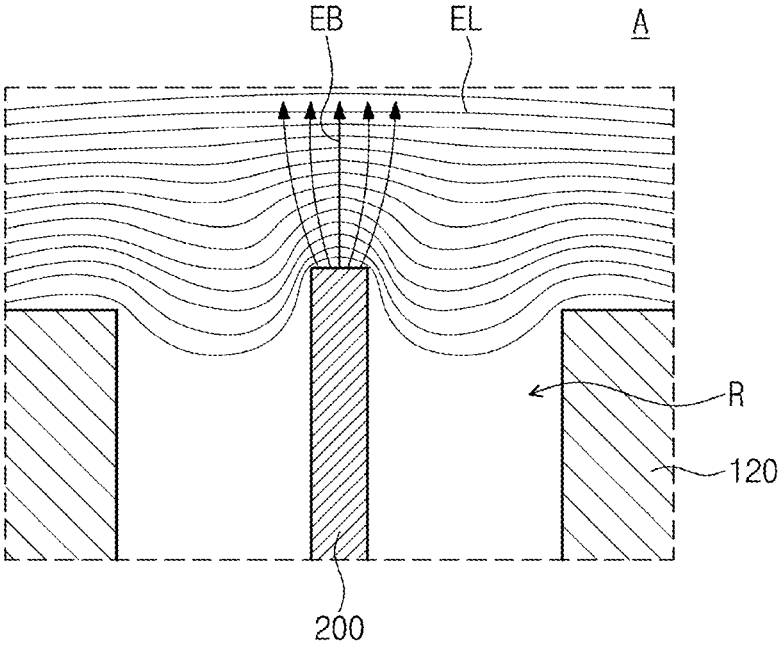
FIG. 4 is an enlarged view of area A of FIG. 2.

FIG. 3 is a view for explaining the electron beam formation of the yarn emitter. FIG. 4 is a view simulating the trajectory of the electrons emitted from the yarn emitter of an electron emission source of the inventive concept, which is an enlarged view of the area A of FIG. 2.

Referring to FIG. 3, the spatial electric field distribution may be formed around the cathode electrode 100. At this time, the equipotential distribution line EL may be distorted according to the geometry of the yarn emitter 200. As shown in FIG. 3, the yarn emitter 200 has a geometrically thin and long tip shape. Depending on the shape of the yarn emitter 200, an electric field may be formed to be bent at one end of the yarn emitter 200 from which the electron beam is emitted. The electrons move under the influence of the applied electric field and the electric field is formed perpendicular to the equipotential distribution line EL so that the electrons move by receiving force in a direction perpendicular to the equipotential distribution line EL. The electrons generated in the yarn emitter 200 may form an electron beam EB traveling in a direction perpendicular to the equipotential distribution line EL. That is, the electron beam EB may be emitted in a shape that radiates along a curved electric field resulting in diverging characteristic.

Referring to FIGS. 1, 2, and 4, the equipotential distribution line EL may be adjusted according to the geometrical shape of the cathode electrode 100. In relation to the electron emission source 10 according to embodiments of the inventive concept, the yarn emitter 200 may be disposed within the recess region R of the cathode electrode 100. For example, the potential control part 120 of the cathode electrode 100 may be disposed outside the yarn emitter 200. By the potential of the potential control part 120 of the cathode electrode 100, the equipotential distribution line EL may be pulled up onto the upper surface of the potential control part 120. The equipotential line EL may be bent on the upper surface of the potential control part 120 to have a gentle bend without gentle bending at the edge of the yarn emitter 200. That is, the distortion of the equipotential distribution line EL may be alleviated, and the electron beam EB may be emitted with a narrow divergence angle.

The electron emission source 10 according to embodiments of the inventive concept may have a small divergence angle of electrons emitted from the yarn emitter 200 and the focusing of the electron beam EB generated from the electron emission source 10 may be easy.

Figure 5:
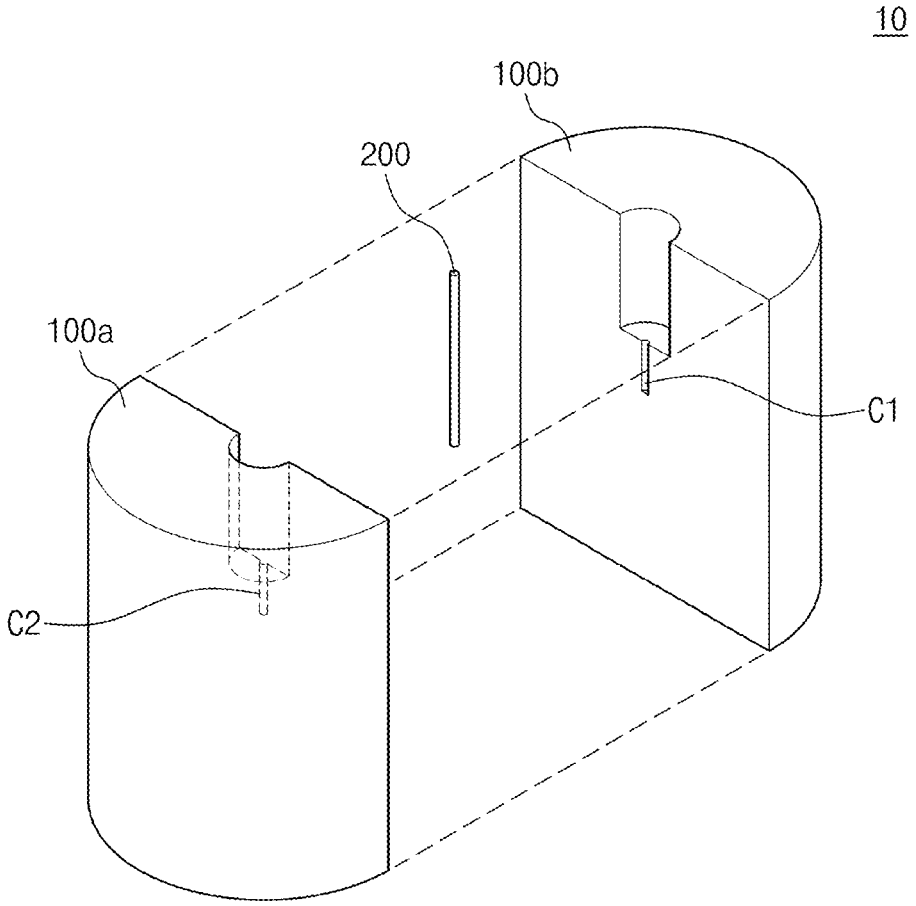
FIG. 5 is a perspective view illustrating an electron emission source according to embodiments of the inventive concept.

FIG. 5 is a perspective view illustrating an electron emission source according to embodiments of the inventive concept.

Referring to FIG. 5, the cathode electrode 100 may have a first portion 100*a* and a second portion 100*b*, which are horizontally separated. In detail, the first portion 100*a* and the second portion 100*b* of the cathode electrode 100 may be symmetrical with respect to the yarn emitter 200 in plan view. The groove C of the cathode electrode 100 may be separated into a first groove C1 and a second groove C2 along the first portion 100*a* and the second portion 100*b*, respectively. If necessary, the first portion 100*a* and the second portion 100*b* may be coupled and separated. For example, the first portion 100*a* and the second portion 100*b* may be mutually fixed using screws (not shown) extending therethrough. The yarn emitter 200 may be inserted into the first groove C1 and the second groove C2 when the first portion 100*a* and the second portion 100*b* are coupled.

In relation to the electron emission source 10 according to the inventive concept, the yarn emitter 200 may be mechanically fixed to the cathode electrode 100 according to the coupling of the first portion 100*a* and the second portion 100*b* of the cathode electrode 100, and accordingly, the yarn emitter 200 may be easily coupled, separated, and replaced.

Figure 6:
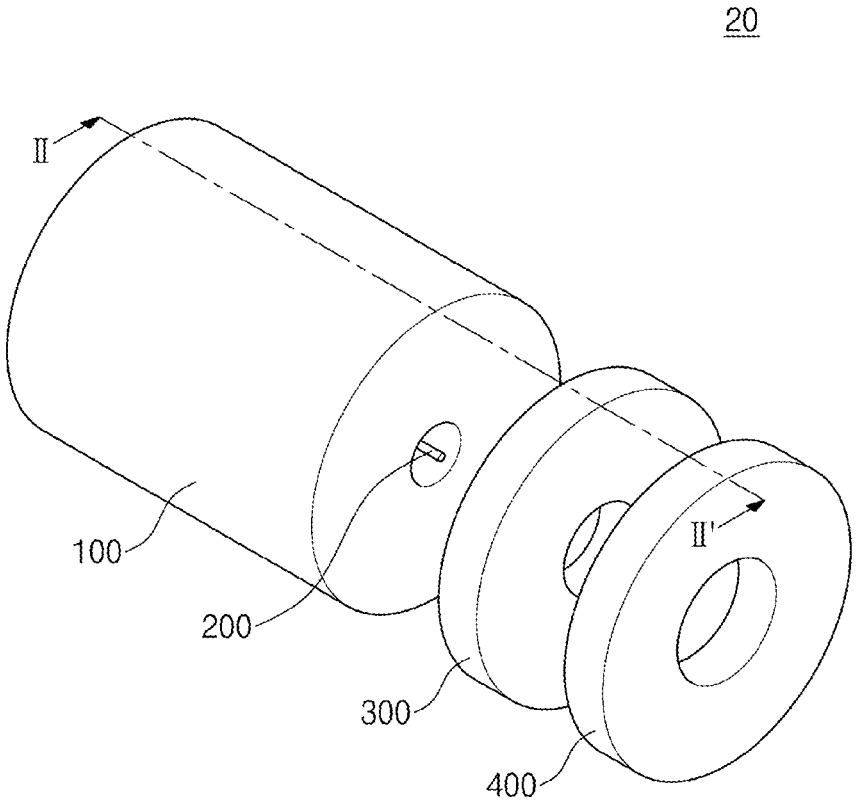
FIG. 6 is a perspective view illustrating an electron emission source according to embodiments of the inventive concept.
Figure 7:
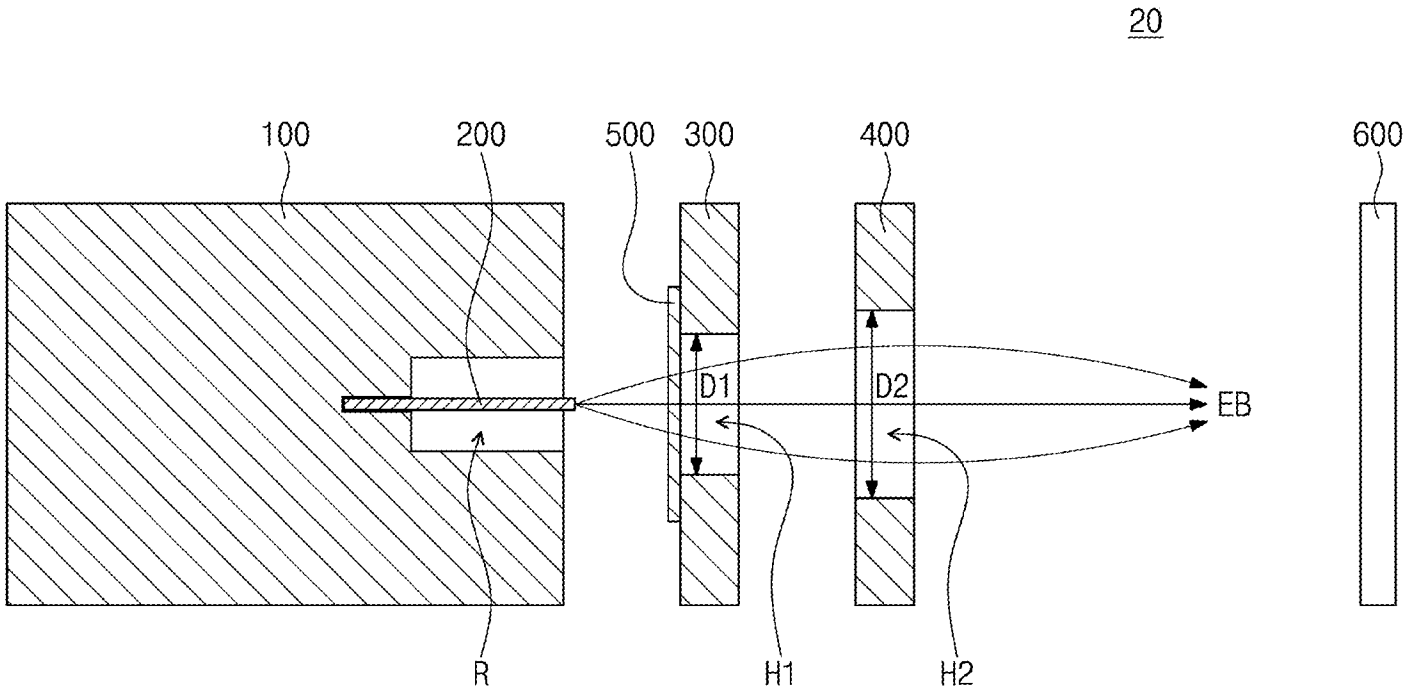
FIG. 7 is a cross-sectional view illustrating an electron emission source according to embodiments of the inventive concept.

FIG. 6 is a perspective view illustrating an electron emission source according to embodiments of the inventive concept. FIG. 7 is a cross-sectional view taken along line II-II' of FIG. 6, illustrating an electron emission source according to embodiments of the inventive concept.

Referring to FIGS. 6 and 7, an electron emission source 20 may further include a gate electrode 300 and a focusing electrode 400.

The gate electrode 300 may be disposed on the cathode electrode 100. The gate electrode 300 may be positioned above the yarn emitter 200 such that it is spaced apart from the yarn emitter 200 by a certain distance. The gate electrode 300 may have a first aperture H1. The first aperture H1 may vertically penetrate the gate electrode 300 in the form of a single hole. At this time, the diameter D1 of the first aperture H1 may be larger than the diameter of the yarn emitter 200. The first aperture H1 of the gate electrode 300 may be located on the path of the electron beam EB emitted from the yarn emitter 200. For example, from a plane viewpoint, the yarn emitter 200 may be disposed within the first aperture H1. Accordingly, the electron beam EB emitted from the yarn emitter 200 may pass through the first aperture H1. The gate electrode 300 may include a conductive material (e.g., a metal). Unlike what is shown, the gate electrode 300 may not have the first aperture H1 in the form of a single aperture. At this time, the gate electrode 300 may be a mesh-type conductor.

The focusing electrode 400 may be disposed on the gate electrode 300. The focusing electrode 400 may be spaced a certain distance from the gate electrode 300. The focusing electrode 400 may have a second aperture H2. The second aperture H2 may vertically penetrate the focusing electrode 400 in the form of a single hole. At this time, the diameter D2 of the second aperture H2 may be larger than the diameter D1 of the first aperture H1 of the gate electrode 300. The second aperture H2 of the focusing electrode 400 may be located on the path of the electron beam EB emitted from the yarn emitter 200. The electron beam EB emitted from the yarn emitter 200 may pass through the first aperture H1 and the second aperture H2.

The gate electrode 300 and the focusing electrode 400 may focus the electron beam EB emitted from the yarn emitter 200. When a potential difference is generated between the gate electrode 300 and the cathode electrode 100, the electron beam EB may be emitted from the end of the yarn emitter 200 toward the gate electrode 300. The electron beam EB emitted from the yarn emitter 200 may pass through the first aperture H1 of the gate electrode 300 and the second aperture H2 of the focusing electrode 400 and then, reach the anode electrode 600. At this time, due to the relative potential difference between the gate electrode 300 and the focusing electrode 400 and the local electric potential distribution distortion around the aperture formed thereby, the electron beam EB may have a bent path, and may be accelerated and focused through relative potential and electrode shape control. For the withdrawal of the electron beam EB, the potential of the gate electrode 300 may be higher than the potential of the cathode electrode and the potential of the focusing electrode 400 may be relatively high or low relative to the two electrodes for the focusing of the electron beam EB.

According to the inventive concept, since the electron beam EB having a small divergence angle is generated in the yarn emitter 200, the leakage of the electron beam EB from the gate electrode 300 and the focusing electrode 400 may be small and the focusing characteristic of the electron beam EB by the gate electrode 300 and the focusing electrode 400 may be enhanced. Therefore, the electron emission source 20 may generate the electron beam EB that is easily focused on the anode electrode 600, and has improved focusing characteristics and high current characteristics.

According to other embodiments, an electron beam transmission layer 500 disposed on one side of the gate electrode 300 may be further included. The electron beam transmission layer 500 may cover the first aperture H1 of the gate electrode 300. That is, the electron beam transmission layer 500 may be located on the path through which the electron beam EB passes. The electron beam transmission layer 500 may include a conductive material having a two-dimensional crystal structure. Here, a two-dimensional crystal structure refers to a crystal structure of materials whose constituent atoms form an atomic layer and in which a bond between the constituent atoms is formed only on a two-dimensional plane. For example, a conductive material having a two-dimensional crystal structure may include graphene. Alternatively, the conductive material having a two-dimensional crystal structure may include molybdenum disulfide (MoS2) or tungsten sulfide (WS2). The electron beam transmission layer 500 may reduce the divergence angle of the electron beam EB. The electron beam transmission layer 500 may not be provided as needed.

Figure 8:
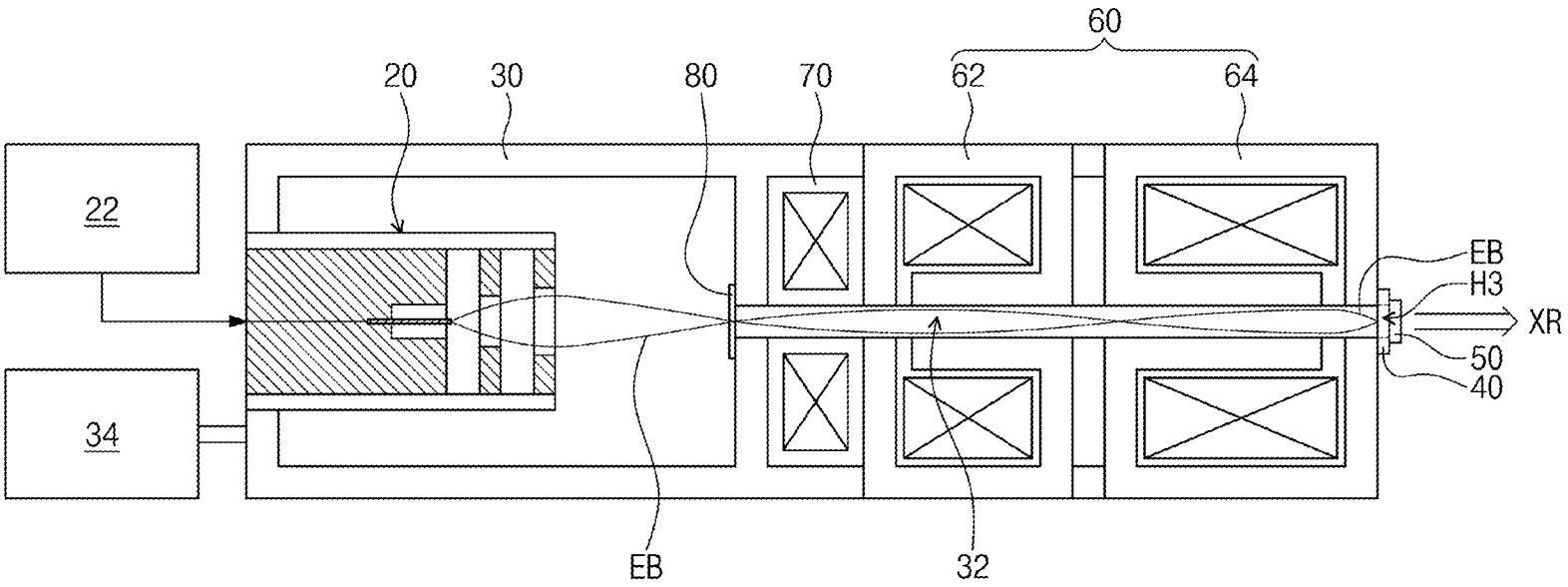
FIG. 8 is a cross-sectional view illustrating an X-ray generator according to embodiments of the inventive concept.

FIG. 8 is a cross-sectional view illustrating an X-ray generator according to embodiments of the inventive concept, and is a view schematically showing an X-ray generator.

Referring to FIG. 8, a housing 30 may be provided. The inside of the housing 30 may be kept in vacuum. For example, an external vacuum pump 34 may be connected to the inside of the housing 30 to keep the inside of the housing 30 in a vacuum state.

An electron emission source 20 may be provided in the housing 30. The electron emission source 20 may be the same as or similar to that described with reference to FIGS. 5 and 6. The electron emission source 20 may be disposed at one end of the housing 30. The electron emission source 20 may generate an electron beam EB in the housing 30 by receiving external power from the power unit 22.

A vacuum tube 32 may be disposed on one side of the electron emission source 20. The vacuum tube 32 may have a shape extending in one direction. The vacuum tube 32 may be a path through which the electron beam EB generated by the electron emission source 20 travels. The vacuum tube 32 may be in a vacuum state.

An anode electrode 40 may be provided at one end of the vacuum tube 32. The position where the anode electrode 40 is disposed may be the other end of the vacuum tube 32 where the electron beam EB arrives. The electron beam EB generated from the electron emission source 20 may reach the anode electrode 40. In order to facilitate the collection of the electron beam EB, the potential of the anode electrode 40 is lower than the potential of the electron emission source 20 (e.g., the potential of the cathode electrode 100, the gate electrode 300, and the focusing electrode 400 described with reference to FIGS. 5 and 6). The anode electrode 40 may have a third aperture H3 vertically penetrating the anode electrode 40. The third aperture H3 of the anode electrode 40 may be located on the path of the electron beam EB.

A target layer 50 may be disposed on one side of the anode electrode 40. The target layer 50 may cover the third aperture H3 of the anode electrode 40. That is, the target layer 50 may be located on the arrival point of the electron beam EB. The target layer 50 may be a transmissive target material. As an example, the target layer 50 may include tungsten (W), yttrium (Y), molybdenum (Mo), tantalum (Ta) or silver (Ag). The target layer 50 may absorb the electron beam EB on one side and generate an X-ray XR on the other side opposite to the one side. As the focusing characteristics of the absorbed electron beam EB is more enhanced, finer X-ray XR may be generated and the resolution of the X-ray may be increased. Unlike this, the target layer 50 may be a reflective target material. In this case, the target layer 50 may absorb the electron beam EB on one side and generate the X-ray XR on the one side. At this time, the anode electrode 40 may not have the third aperture H3.

A magnetic lens 60 may be provided between the electron emission source 20 and the anode electrode 40. The magnetic lens 60 may surround the vacuum tube 32, i.e., the path of the electron beam. The magnetic lens 60 may focus the electron beam EB passing through the vacuum tube 32. The magnetic lens 60 may include a condenser lens 62 that controls the initial focusing characteristics or an objective lens 64 that determines the size of the final electron beam.

A magnetic lens 60 may be provided between the electron emission source 20 and the anode electrode 40. The alignment coil 70 may surround the traveling path of the electron beam EB. The alignment coil 70 may control the traveling path of the electron beam EB so that the electron beam EB generated by the electron emission source 20 may pass through the vacuum tube 32.

An electron beam control layer 80 may be provided between the electron emission source 20 and the magnetic lens 60. The electron beam control layer 80 may be located on the traveling path of the electron beam EB. The electron beam control layer 80 may be substantially the same as the electron beam transmission layer 500 described with reference to FIGS. 5 and 6. For example, the electron beam control layer 80 may reduce the divergence angle of the electron beam EB. The electron beam control layer 80 may not be provided as needed.

The electron emission source 20 according to the inventive concept may generate an electron beam EB having an improved focusing characteristics. The X-ray generator 1 using the electron beam EB may generate a fine X-ray XR and the resolution of the X-ray XR may be increased. That is, the X-ray generator 1 may generate a high-resolution X-ray XR by focusing the electron beam EB of a very small area emitted from the electron emission source 20 to the magnetic lens 60.

In relation to the electron emission source according to the inventive concept, depending on the geometry of the cathode electrode, the local equipotential distribution line around the electron emission source may be adjusted. By the potential of the potential control part of the cathode electrode, the equipotential distribution line may be pulled up onto the upper surface of the potential control part. That is, the distortion of the equipotential distribution line may be alleviated, and the electron beam may be emitted with a narrow divergence angle. Accordingly, the divergence angle of the electrons emitted from the yarn emitter may be small, and the electron beam generated from the electron emission source may be easily focused. Therefore, an electron beam having an enhanced focusing characteristics and improved high current characteristics may be generated. In addition, the amount of electrons leaked to the outside of the electrons emitted from the yarn emitter may be small.

As the yarn emitter 200 is inserted and mechanically coupled into the groove C of the cathode electrode 100, the electron emission source according to the inventive concept may be stably fixed, and it is possible to stably emit an electron beam without a movement of the yarn emitter 200 during the operation of the electron emission source 10. That is, the structural stability of the electron emission source 10 may be improved. Also, depending on the coupling of the first and second portions of the cathode electrode, the yarn emitter may be fixed, which makes it easy to couple, separate, and replace the yarn emitter.

The electron emission source according to the inventive concept may generate an electron beam having an improved focusing characteristics. The X-ray generator using the electron beam EB may generate a fine X-ray and the resolution of the X-ray may be increased.

Although the exemplary embodiments of the inventive concept have been described, it is understood that the inventive concept should not be limited to these exemplary embodiments but various changes and modifications can be made by one ordinary skilled in the art within the spirit and scope of the inventive concept as hereinafter claimed.

What is claimed is:

1. An electron emission source comprising:

a cathode electrode having a recess region formed in an upper portion thereof; and a yarn emitter having a tip shape and provided in the recess region of the cathode electrode, wherein the yarn emitter is spaced from an inner surface of the recess region of the cathode electrode.

2. The electron emission source of claim 1, wherein the yarn emitter extends from a bottom surface of the recess region in a direction perpendicular to an upper surface of the cathode electrode.

3. The electron emission source of claim 2, wherein the cathode electrode has a groove formed from the bottom surface of the recess region toward the inside of the cathode electrode, wherein the yarn emitter is inserted into the groove and mechanically coupled with the cathode electrode.

4. The electron emission source of claim 3, wherein the cathode electrode has a first portion and a second portion which are horizontally separated from each other and are symmetrical with respect to the yarn emitter, wherein the groove comprises:

a first groove connected to the recess region in the first portion; and a second groove connected to the recess region in the second portion and corresponding to the first groove, wherein the yarn emitter is coupled to the first groove and the second groove.

5. The electron emission source of claim 1, wherein the yarn emitter protrudes from an upper surface of the cathode electrode.

6. The electron emission source of claim 1, further comprising a gate electrode having a single aperture and disposed at an upper part of the yarn emitter while maintaining a certain distance from the yarn emitter.

7. The electron emission source of claim 6, further comprising an electron beam transmission layer disposed on one side of the gate electrode and configured to cover the aperture of the gate electrode.

8. The electron emission source of claim 6, further comprising a focusing electrode provided at a position farther from the cathode electrode than the gate electrode and having a single aperture.

9. The electron emission source of claim 8, wherein a diameter of the aperture of the focusing electrode is larger than a diameter of the aperture of the gate electrode.

10. The electron emission source of claim 6, wherein a diameter of the aperture of the gate electrode is larger than a width of the yarn emitter.

11. The electron emission source of claim 1, wherein the yarn emitter comprises a carbon nano tube (CNT).

12. An X-ray generator comprising:

an electron emission source;

a vacuum tube in which an electron beam generated from the electron emission source travels;

a target attached to the vacuum tube so as to be disposed on a traveling path of the electron beam and configured to emit an X-ray by collision with the electron beam; and a magnetic lens disposed outside the vacuum tube and configured to control the traveling path of the electron beam, wherein the electron emission source comprises:

a cathode electrode having a support part and a potential control part disposed on the support part; and a tip-shaped yarn emitter provided in an aperture vertically penetrating the potential control part.

13. The X-ray generator of claim 12, further comprising an alignment coil disposed between the electron emission source and the magnetic lens.

14. The X-ray generator of claim 12, further comprising an electron beam control layer disposed on a traveling path of an electron beam between the electron emission source and the magnetic lens.

15. The X-ray generator of claim 12, further comprising a vacuum pump connected to a housing in which the electron emission source is provided, wherein an inside of the housing is in a vacuum state.

* * * * *